US011179752B2

(12) United States Patent
Liu et al.

(10) Patent No.: US 11,179,752 B2
(45) Date of Patent: Nov. 23, 2021

(54) ROLLER-TYPE WHEEL FLANGE SURFACE POWDER REMOVING DEVICE

(71) Applicant: CITIC DICASTAL CO., LTD, Hebei (CN)

(72) Inventors: Xiao Liu, Hebei (CN); Jiandong Guo, Hebei (CN)

(73) Assignee: CITIC DICASTAL CO., LTD., Qinhuangdao (CN)

( * ) Notice: Subject to any disclaimer, the term of this patent is extended or adjusted under 35 U.S.C. 154(b) by 347 days.

(21) Appl. No.: 16/247,017

(22) Filed: Jan. 14, 2019

(65) Prior Publication Data

US 2019/0321866 A1 Oct. 24, 2019

(30) Foreign Application Priority Data

Apr. 19, 2018 (CN) ..... 201810351891.3

(51) Int. Cl.

| | |
|---|---|
| ***B08B 1/04*** | (2006.01) |
| ***B08B 1/00*** | (2006.01) |
| ***B08B 5/04*** | (2006.01) |
| *B08B 9/02* | (2006.01) |
| *B24B 9/00* | (2006.01) |
| *A47L 5/16* | (2006.01) |
| *B24B 9/02* | (2006.01) |
| *B08B 9/04* | (2006.01) |
| *B24B 19/28* | (2006.01) |
| *B24B 19/26* | (2006.01) |

(52) U.S. Cl.

CPC ..... *B08B 1/04* (2013.01); *B08B 1/002* (2013.01); *B08B 1/008* (2013.01); *B08B 5/04* (2013.01); *A47L 5/16* (2013.01); *B08B 9/02* (2013.01); *B08B 9/04* (2013.01); *B24B 9/005* (2013.01); *B24B 9/02* (2013.01); *B24B 19/26* (2013.01); *B24B 19/28* (2013.01)

(58) Field of Classification Search

CPC ..... B08B 1/04; B08B 1/002; B08B 1/008; B08B 5/04; B24B 9/04; B24B 9/005; B24B 9/02; B24B 19/28; B24B 19/26; A47L 5/06; A47L 5/16; A47L 5/22; A47L 9/0693; A47L 9/22

USPC ..... 15/88.4, 21.1, 88.3, 77, 301; 451/258

See application file for complete search history.

(56) References Cited

FOREIGN PATENT DOCUMENTS

JP 3044289 B2 * 5/2000

* cited by examiner

*Primary Examiner* — Katina N. Henson

(74) *Attorney, Agent, or Firm* — IPro, PLLC

(57) ABSTRACT

The present invention discloses a roller-type wheel flange surface powder removing device, that includes a corresponding roller brush that is replaced according to the size of a wheel to be processed. A manipulator places the wheel at corresponding positions of limit discs, output ends of cylinders extend to drive pressure blocks to press the wheel, and a sliding seat and a mechanism thereon reciprocate along with a rack within the travel range of guide pillars. While a second motor starts working, a first motor drives a second gear to rotate, and a first gear transmits the rotation speed to the roller brush through a support shaft according to a certain transmission ratio. The roller brush is driven by a third gear 23 and a rack 24 while rotating with the support shaft. The roller brush reciprocates to clean the surface of the wheel.

1 Claim, 2 Drawing Sheets

ROLLER-TYPE WHEEL FLANGE SURFACE POWDER REMOVING DEVICE

CROSS REFERENCE TO RELATED APPLICATION

This application claims priority to Chinese Patent Application No. 201810351891.3, entitled ROLLER-TYPE WHEEL FLANGE SURFACE POWDER REMOVING DEVICE and filed on Apr. 19, 2018, which is incorporated herein by reference for all purposes.

FIELD OF THE INVENTION

The present invention relates to surface treatment, and specifically relates to a wheel flange surface treatment device.

BACKGROUND OF THE INVENTION

After the machining of a wheel, it is necessary to spay several layers of different types of powder, paint and other attachments for protection and decoration. Considering the assembly requirements of the wheel, the wheel flange flat surface is not allowed to carry any powder or paint, but the powder or paint is inevitably attached to the wheel flange flat surface during spraying or transport. At present, the attachments on the wheel flange flat surfaces are usually manually removed by workers, so that the labor cost is high, the consistency is unlikely to guarantee, and the treatment efficiency is low.

SUMMARY OF THE INVENTION

The objective of the present invention is to provide a roller-type wheel flange surface powder removing device, which improves the quality and efficiency of removing attachments from a wheel flange flat surface.

A roller-type wheel flange surface powder removing device includes upper bottom plates 1, cylinders I 2, limit discs 3, pressure blocks 4, a first bearing cover I 5, a first bearing I 6, a first gear I 7, a support shaft 8, a roller brush 9, a second bearing II 11, a second bearing cover II 12, a joint nut 13, first support plates I 14, a first motor I 15, struts I 16, a suction fan 17, a second motor II 18, a coupling 19, a second gear II 20, a lower bottom plate 21, second support plates II 22, a third gear III 23, a rack 24, guide pillars I 25, a sliding seat 26 and a motor I shield 27.

As shown in FIGS. 1-3, the four struts I 16 are uniformly distributed on the lower bottom plate 21, the upper bottom plates 1 are mounted on the four struts I 16, and the limit discs 3 are mounted on the upper bottom plates 1. The three cylinders I 2 are uniformly distributed and mounted on the upper bottom plates 1, the three pressure blocks 4 are respectively connected to the corresponding cylinders I 2 and the limit discs 3, and the two second support plates II 22 are symmetrically mounted on two sides of the lower bottom plate 21. The two guide pillars I 25 are mounted on the two second support plates II 22 through the sliding seat 26, and the rack 24 is mounted under the sliding seat 26 by bolt connection. The second motor II 18 is mounted on the lower base plate 21, the third gear III 23 is mounted at an output end of the second motor II 18, and the third gear III 23 is engaged with the rack 24, while the first motor 115 is mounted on the sliding seat 26, and the second gear II 20 is mounted at an output end of the first motor I 15 via the coupling 19. The motor I shield 27 encloses the first motor 115 and the coupling 19 therein and is mounted on the sliding seat 26. The two first support plates 14 are symmetrically mounted on two sides of the sliding seat 26. The first gear 17 is mounted on the left side of the support shaft 8, the first bearing 16 is sleeved on the left side of the support shaft 8 and mounted in a through hole of the left first support plate I 14, and the first bearing cover 15 is mounted on the left first support plate I 14 to restrict the axial movement of the support shaft 8. The roller brush 9 is mounted on the support shaft 8, the right side of the support shaft 8 is sleeved with the second bearing II 11 and mounted in a through hole of the right first support plate I 14, the second bearing cover II 12 is mounted on the right first support plate I 14 to restrict the axial movement of the support shaft 8, and the joint nut 13 of the suction fan 17 is mounted on the right side of the second bearing cover II 12.

In actual use, the corresponding roller brush 9 is replaced according to the size of a wheel 10 to be processed, and a manipulator places the wheel 10 at corresponding positions of the limit discs 3. The output ends of the cylinders I 2 extend to drive the pressure blocks 4 to press the wheel 10, and the second motor II 18 drives the third gear III 23 to rotate according to a certain rotation speed. The rack 24 moves at a certain speed under the drive of the third gear III 23, and the sliding seat 26 and the mechanism thereon reciprocate along with the rack 24 within the travel range of the guide pillars I 25. While the second motor II 18 starts working, the first motor I 15 drives the second gear II 20 to rotate, and the first gear I 7 transmits the rotation speed to the roller brush 9 through the support shaft 8 according to a certain transmission ratio. The roller brush 9 is driven by the third gear III 23 and the rack 24 while rotating with the support shaft 8. After the roller brush 9 reciprocates a few times on the flange flat surface of the wheel 10, the powder or paint on the flange flat surface of the wheel 10 is cleaned. At this time, the output ends of the cylinders I 2 are contracted, the pressure blocks 4 are expanded, and the manipulator clamps the wheel 10 to next process.

The step sizes of the limit discs respectively correspond to a plurality of wheels of different sizes, and each step size is 5 mm more than the diameter of the inner rim of the wheel, so that the device can adapt to more sizes of wheels, and the radial positioning error of the wheel can be covered by the size of the roller brush.

The guide pillars I ensure the stability of the sliding seat and the mechanism thereon during moving.

The pressure blocks are made of a soft material, which avoids pressure marks on the rim of the wheel due to too hard materials for the pressure blocks.

The roller brush is of a hollow structure, with brushes and vent holes being uniformly distributed on the outer surface thereof, and each vent hole acting as a suction port when the suction fan 17 starts to work, such that the dust around the holes is sucked away.

Part of the support shaft is a hollow shaft that acts as a conduit for dust and air circulation when the suction fan starts to work.

The transmission mechanism of the third gear III and the rack and the transmission mechanism of the first gear I and the second gear II have a simple transmission mode, which is suitable for operation in a dusty harsh environment.

The powder removing device provided by the present invention greatly improves the cleaning effect on the flange flat surface of the wheel and the production processing efficiency of the workshop, and avoids the influence of human factors such as the operation level of workers in the workshop on the cleaning effect and the production processing efficiency.

Figure 1:
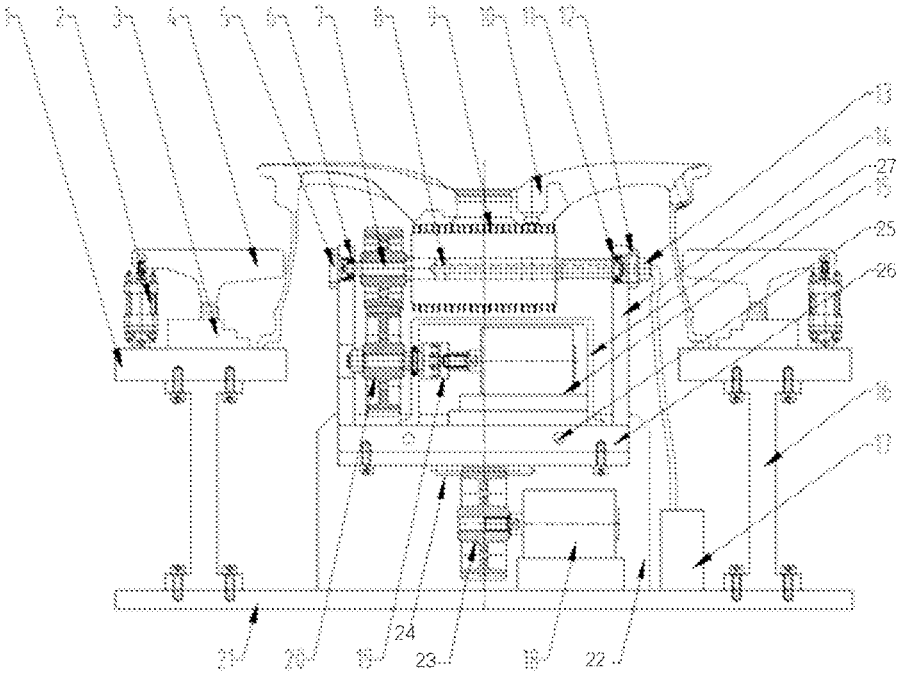
FIG. 1 is a front elevational view of a roller-type wheel flange surface powder removing device according to the present invention.
Figure 2:
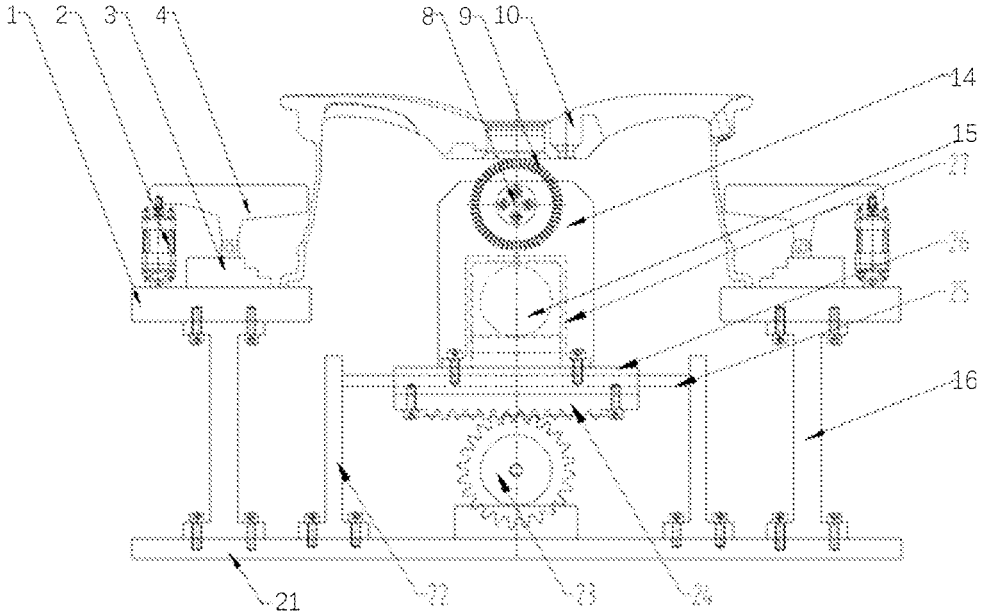
FIG. 2 is a left elevational view of the roller-type wheel flange surface powder removing device according to the present invention.
Figure 3:
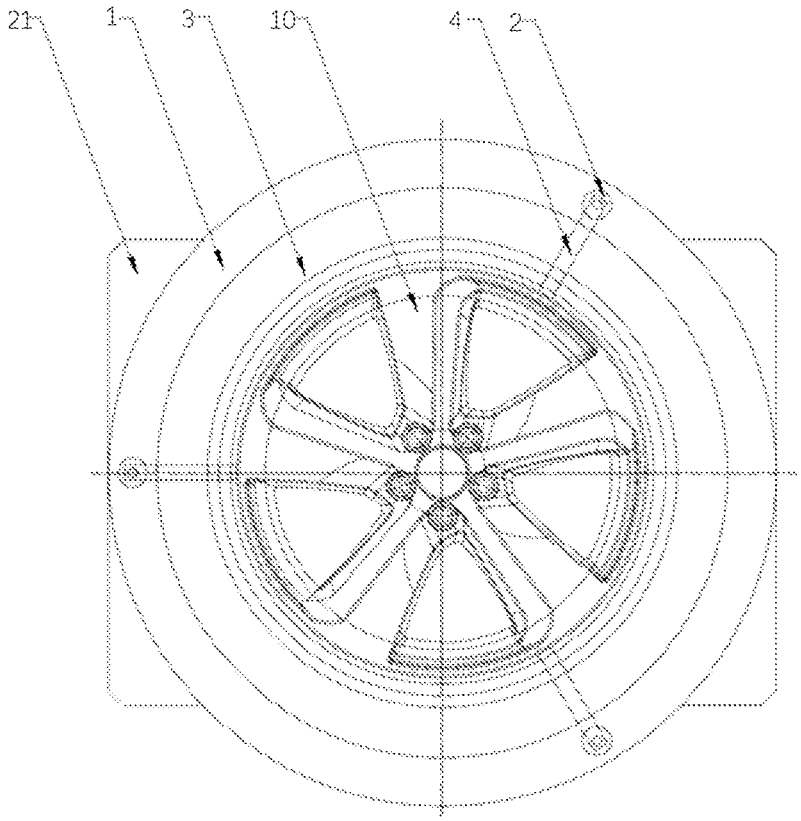
FIG. 3 is a top plan view of the roller-type wheel flange surface powder removing device according to the present invention.

In which: 1—upper bottom plate, 2—cylinder I, 3—limit disc, 4—pressure block, 5—first bearing cover I, 6—first bearing I, 7—first gear I, 8—support shaft, 9—roller brush, 10—wheel, 11—second bearing II, 12—second bearing cover II, 13—joint nut, 14—first support plate I, 15—motor I, 16—strut I; 17—suction fan, 18—second motor II, 19—coupling, 20—second gear II, 21—lower bottom plate, 22—second support plate II, 23—third gear III, 24—rack, 25—guide pillar I, 26—sliding seat, 27—motor I shield.

DETAILED DESCRIPTION OF EMBODIMENTS

The specific embodiments of the present invention will be further described in detail below in combination with the accompanying drawings.

A roller-type wheel flange surface powder removing device includes upper bottom plates 1, cylinders I 2, limit discs 3, pressure blocks 4, a first bearing cover I 5, a first bearing I 6, a first gear I 7, a support shaft 8, a roller brush 9, a second bearing II 11, a second bearing cover II 12, a joint nut 13, first support plates I 14, a first motor I 15, struts I 16, a suction fan 17, a second motor II 18, a coupling 19, a second gear II 20, a lower bottom plate 21, second support plates II 22, a third gear III 23, a rack 24, guide pillars I 25, a sliding seat 26 and a motor I shield 27.

The four struts I 16 are uniformly distributed on the lower bottom plate 21, the upper bottom plates 1 are mounted on the four struts I 16, and the limit discs 3 are mounted on the upper bottom plates 1. The three cylinders I 2 are uniformly distributed and mounted on the upper bottom plates 1, and the three pressure blocks 4 are respectively connected to the corresponding cylinders I 2 and the limit discs 3, and the two second support plates II 22 are symmetrically mounted on two sides of the lower bottom plate 21. The two guide pillars I 25 are mounted on the two second support plates II 22 through the sliding seat 26, and the rack 24 is mounted under the sliding seat 26 by bolt connection. The second motor II 18 is mounted on the lower base plate 21, the third gear III 23 is mounted at an output end of the second motor II 18, and the third gear III 23 is engaged with the rack 24. The first motor I 15 is mounted on the sliding seat 26, and the second gear II 20 is mounted at an output end of the first motor I 15 via the coupling 19. The motor I shield 27 encloses the first motor I 15 and the coupling 19 therein and is mounted on the sliding seat 26. The two first support plates 14 are symmetrically mounted on two sides of the sliding seat 26. The first gear I 7 is mounted on the left side of the support shaft 8, the first bearing I 6 is sleeved on the left side of the support shaft 8 and mounted in a through hole of the left first support plate I 14, and the first bearing cover I 5 is mounted on the left first support plate I 14 to restrict the axial movement of the support shaft 8. The roller brush 9 is mounted on the support shaft 8, the right side of the support shaft 8 is sleeved with the second bearing II 11 and mounted in a through hole of the right first support plate I 14, the second bearing cover II 12 is mounted on the right first support plate I 14 to restrict the axial movement of the support shaft 8, and the joint nut 13 of the suction fan 17 is mounted on the right side of the second bearing cover II 12.

In actual use, the corresponding roller brush 9 is replaced according to the size of a wheel 10 to be processed, and a manipulator places the wheel 10 at corresponding positions of the limit discs 3. The output ends of the cylinders I 2 extend to drive the pressure blocks 4 to press the wheel 10, and the second motor II 18 drives the third gear III 23 to rotate according to a certain rotation speed. The rack 24 moves at a certain speed under the drive of the third gear III 23, and the sliding seat 26 and the mechanism thereon reciprocate along with the rack 24 within the travel range of the guide pillars I 25. While the second motor II 18 starts working, the first motor I 15 drives the second gear II 20 to rotate, and the first gear I 7 transmits the rotation speed to the roller brush 9 through the support shaft 8 according to a certain transmission ratio. The roller brush 9 is driven by the third gear III 23 and the rack 24 while rotating with the support shaft 8. After the roller brush 9 reciprocates a few times on the flange flat surface of the wheel 10, the powder or paint on the flange flat surface of the wheel 10 is cleaned. At this time, the output ends of the cylinders I 2 are contracted, the pressure blocks 4 are expanded, and the manipulator clamps the wheel 10 to next process.

In actual production, one wheel model is usually produced in at least one shift, and the roller brush 9 does not need to be replaced frequently, so that the workshop production processing has certain continuity, the auxiliary time is reduced and the production efficiency is improved.

After the roller brush 9 has brushed a certain number of wheels 10, the roller brush 9 itself may become contaminated with too much dust, so that the flange flat surface of the wheel 10 cannot be cleaned. Therefore, every time the roller brush 9 works a period of time, the suction fan 17 starts to work, and the dust on the surface of the roller brush 9 is sucked away by small holes of the roller brush 9 and a hollow portion of the support shaft 8.

The invention claimed is:

1. A roller-type wheel flange surface powder removing device, comprising:

a lower bottom plate;

four struts uniformly distributed on the lower bottom plate;

an upper bottom plate mounted on the four struts;

limit discs mounted on the upper bottom plates;

three cylinders uniformly distributed and mounted on the upper bottom plate;

three pressure blocks respectively connected to the corresponding cylinders and the limit discs;

two second support plates symmetrically mounted on two sides of the lower bottom plate;

a sliding seat;

two guide pillars mounted on the two second support plates and passing through the sliding seat;

a rac mounted under the sliding seat by a bolt connection;

a second motor mounted on the lower bottom plate;

a third gear mounted at an output end of the second motor, the third gear is engaged with the rack;

a first motor mounted on the sliding seat, a second gear mounted at an output end of the first motor via a coupling;

a first motor shield enclosing the first motor and the coupling therein and mounted on the sliding seat;

two first support plates symmetrically mounted on two sides of the sliding seat;

a support shaft having a first side and a second side;

a first gear mounted on the first side of the support shaft, the first gear is engaged with the second gear;

a first bearing sleeved on the first side of the support shaft and mounted in a through hole of a first one of the two first support plates;

a first bearing cover mounted on the first one of the two first support plates to restrict an axial movement of the support shaft;

a roller brush mounted on the support shaft;

a second bearing sleeved on the second side of the support shaft and mounted in a through hole of a second one of the first support plates;

a second bearing cover mounted on the second one of the two first support plates to restrict the axial movement of the support shaft; and a suction fan having a joint nut mounted on a right side of the second bearing cover, when a wheel is placed at corresponding positions of the limit discs, output ends of the three cylinders extend to drive the three pressure blocks to press the wheel, the second motor drives the third gear to rotate, the rack moves under the drive of the third gear, and the sliding seat and the roller brush reciprocate along with the rack within a travel range of the two guide pillars, the first motor drives the second gear to rotate, and the first gear rotates under the drive of the second gear and drives the roller brush to rotate through the support shaft, the roller brush reciprocates on a flange surface of the wheel to clean powder or paint on the flange surface of the wheel, wherein the roller brush has a hollow structure and has brushes and vent holes uniformly distributed on an outer surface thereof, at least part of the support shaft is a hollow shaft, when the suction fan works, each vent hole of the roller brush acts as a suction port, and the hollow shaft is configured to act as a conduit for dust and air circulation, so that dust around the vent holes is sucked away.

* * * * *